United States Patent [19]

Lindberg

[11] Patent Number: 5,020,415

[45] Date of Patent: Jun. 4, 1991

[54] TANKS

[75] Inventor: Sven Lindberg, Degerfors, Sweden

[73] Assignee: Aktiebolaget Bofors, Bofors, Sweden

[21] Appl. No.: 420,430

[22] Filed: Oct. 12, 1989

[30] Foreign Application Priority Data

Oct. 12, 1988 [SE] Sweden ..... 8803614

[51] Int. Cl.[5] ..... F41A 9/13

[52] U.S. Cl. ..... 89/46

[58] Field of Search ..... 89/45, 46, 47, 36.08

[56] References Cited

U.S. PATENT DOCUMENTS

| | | | |
|---|---|---|---|
| 668,835 | 2/1901 | von Hanneken | 89/46 |
| 4,144,797 | 3/1979 | Berge et al. | 89/46 |
| 4,326,446 | 4/1982 | Magnuson | 89/45 |
| 4,632,011 | 12/1986 | Metz et al. | 89/46 |
| 4,819,518 | 4/1989 | Pahnke | 89/47 |

FOREIGN PATENT DOCUMENTS

| | | | |
|---|---|---|---|
| 1959548 | 6/1971 | Fed. Rep. of Germany | 89/36.08 |
| 3440041 | 5/1986 | Fed. Rep. of Germany . | |
| 1251176 | 10/1971 | United Kingdom | 89/46 |

*Primary Examiner*—Deborah L. Kyle
*Assistant Examiner*—Stephen Johnson
*Attorney, Agent, or Firm*—Pollock, Vande Sande & Priddy

[57] ABSTRACT

A tank with an overlying gun which is mounted in a cradle disposed on the crew turret also includes a loading pendulum which is disposed on a journal ring and pivotal in relation to the crew turret. The loading pendulum and the gun are asymmetrically journalled, such that the positions of the gun and the loading pendulum are dependent upon the elevation/depression of the gun. The gun is longitudinally/vertically displaced in the plane of elevation on elevation/depression. This is achieved in that the cradle is retractably disposed in the plane of elevation with the aid of a member determining the degree of retraction of the gun and may be elevated/depressed about an abutment pivotally mounted between the revolving portion, or turret, and the gun. The abutment is movable in the plane of elevation. The abutment and the cradle are adapted in the different elevations/depressions, to adjust the position of the breech of the gun to the pivotal movement of the loading pendulum about its pivotal center.

14 Claims, 1 Drawing Sheet

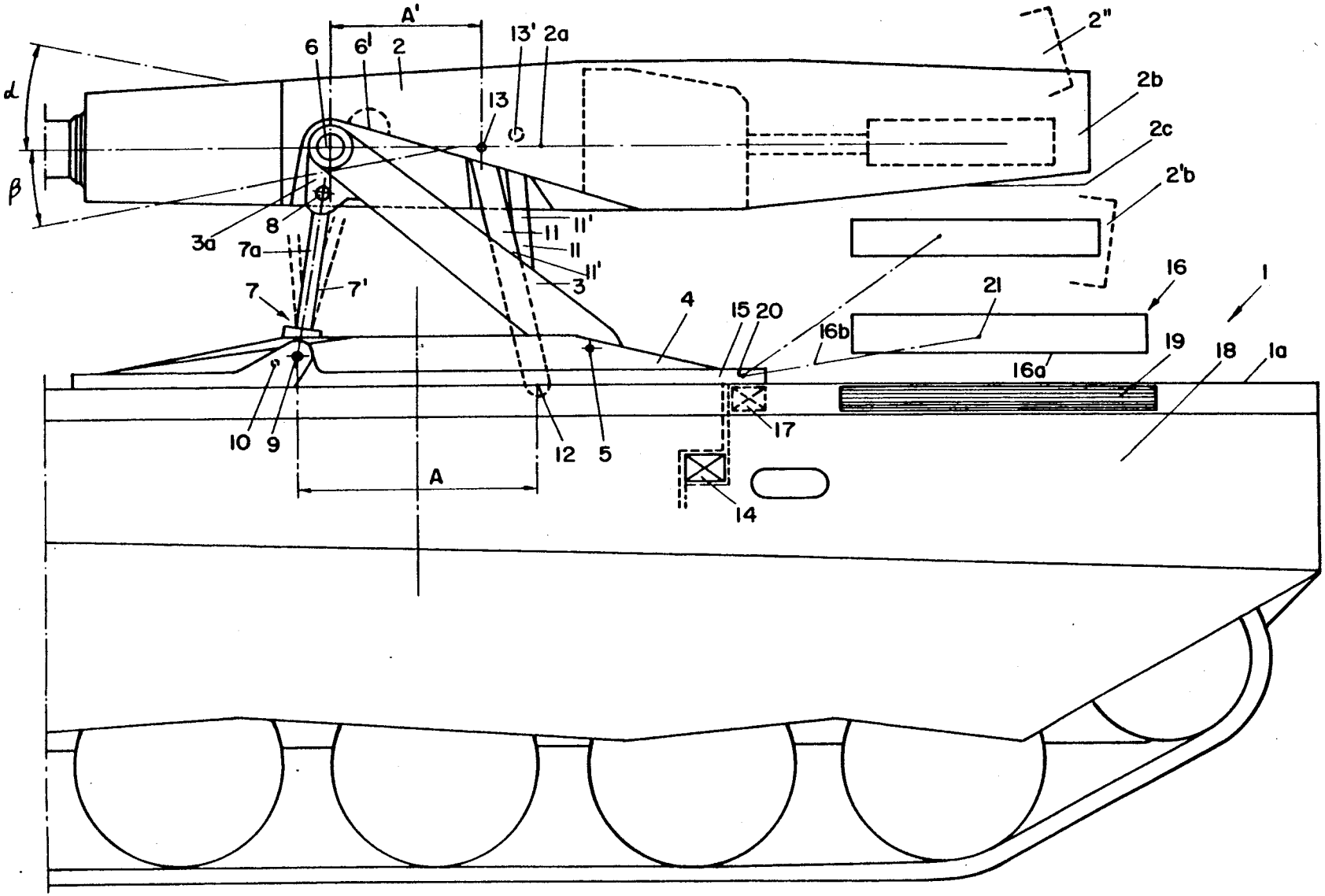
1
1a
18
19
16
16a
16b
21
2"
2b
2c
2'b
17
14
15
20
4
5
12
11'
11
3
2a
13'
13
A'
2
6'
6
7'
8
7a
7
3a
9
10
A
α
β

TANKS

BACKGROUND OF THE INVENTION

1. Technical Field

The present invention relates to a device in a tank having an overlying gun mounted in a cradle disposed on a revolving portion, for example the crew turret, in the tank, and with a loading pendulum disposed in a journal ring which is rotatable in relation to the revolving portion. Seen in the elevation plane, the journal arm of the loading pendulum pivots about a pivotal center which is offset from the pivotal center of the gun in the cradle.

2. Background Art

Tanks with an overlying gun and loading pendulum disposed outside the tank between the magazine and the breech block of the gun are previously known. The loading pendulum may then be arranged, when the gun is traversed, to be laterally rotatable to collect rounds from the magazine and inwardly and upwardly swinging a collected round to the breech of the traversed gun.

The loading pendulum is carried in a journal ring which is rotatable in relation to the revolving portion, for example carrying the gun crew turret. For functional reasons, it has been deemed appropriate to allocate to the loading pendulum a pivotal movement about a pivotal center which is offset from the pivotal center of the journalling of the gun in its associated cradle.

Because of the above-mentioned asymmetrical journalling of the gun and the loading pendulum, a mutual positional displacement will take place between the positions of the loading pendulum and the breech in different elevations of the gun. Attempts have been made in this art to adapt this asymmetry by modifying the pendulum movement in response to the angle of elevation of the gun. Such arrangements are technically complex and operationally unsatisfactory. Also attempts have also been made in this art to solve this problem by returning the gun to an initial position of elevation during the loading cycle.

SUMMARY OF THE INVENTION

The primary object of the present invention is to provide a device that obviates the disadvantages disclosed in the foregoing. The novel device according to the present invention includes a gun mounting which, in conjunction with the elevation movement, automatically adapts the position of the breech to the movements of the loading pendulum.

According to the novel features of the present invention, the cradle is retractable in the plane of elevation, with a member determining the degree of retraction; and the gun may be elevated/depressed about a device journalled around the revolving portion and the gun, this device being movable in the plane of elevation; and the member determining the degree of retraction, the cradle and the abutment are arranged so as, to adapt in the different positions of elevation/depression of the gun, the position of the breech of the gun to the pivotal movement of the loading pendulum about its pivotal center.

In further developments of the inventive concept, the abutment is pivotally journalled, in the plane of elevation, in the revolving portion (the crew turret) and the gun. The abutment may further be journalled in the gun proper in an imaginary extension of the bore axis. The journalling of the abutment in the revolving portion is disposed between the journalling of the cradle in the revolving portion and the journalling of the device determining the degree of retraction of the cradle in the revolving portion.

In one embodiment of the device according to the present invention, a distance between the journalling of the cradle and the anchorage of the member determining the degree of retraction in the revolving portion may exceed a distance between the journalling of the gun in the cradle and the journalling of the abutment in the gun. The device determining the degree of retraction of the cradle may consist of one or two first hydraulic cylinders or first screws. The abutment may consist of one or two second hydraulic cylinders or second screws. The first hydraulic cylinders co-operate with the cradle, preferably at the upper free ends thereof. The journal arm of the loading pendulum may be carried in a journal on the journal ring which, when the loading pendulum is inwardly pivoted in the plane of elevation, is located behind the journalling of the cradle in the revolving portion for example, the crew turret.

The novel device according to the present invention ensures an efficient and rapid loading cycle which is dependent on the elevation of the gun. Moreover, an arrangement for gun journalling will be obtained which allows for a gun to be raised and lowered in relation to the upper side of the hull of the tank. The abutment device may be vertically adjustable.

BRIEF DESCRIPTION OF THE ACCOMPANYING DRAWING

The nature of the present invention and its aspects will be more readily understood from the following brief description of the accompanying Drawings, and discussion relating thereto of one currently proposed embodiment of a device displaying the important characteristics of the present invention.

In the accompanying drawing:

The sole FIGURE illustrates parts of a tank relevant to the present invention, the overlying gun of the tank being shown in two positions of elevation, each being adapted to the pivotal movement of the loading pendulum about its pivotal center.

DESCRIPTION OF THE PREFERRED EMBODIMENTS

Referring to the Drawing, a tank is indicated by reference numeral 1. The tank is fitted with an overlying gun 2 which is carried in a cradle 3 on upper parts of a crew turret 4 which is revolvable in the hull of the tank. The cradle 3 is retractable in the plane of elevation of the gun which, in the FIGURE, coincides with the plane of the Drawing. Retraction is effected about a journal which is symbolically indicated by reference numeral 5. The journalling of the gun in the free ends of the cradle is designated by reference numeral 6.

Retraction is effected with the aid of hydraulic cylinders 7, 7' determining the degree of retraction and substantially parallel to each other of which a piston rod or ram is indicated *7a*. The cylinders are two in number and each respective piston rod *7a* is secured at each respective free end of the cradle each in their journal 8 disposed in a journalling portion *3a* on the cradle. Each respective cylinder 7 is provided with a pivotal journal 9 in the crew turret, where a journalling portion 10 is provided for each respective cylinder. These cylinders may, in principle, also consist of other corresponding devices, for example screws.

An abutment, about which the gun is elevated/depressed, is illustrated by reference numeral 11. The abutment is movably carried in journals 12 and 13 in the gun and the crew turret 4, respectively, seen in the plane of elevation. The journal 13 is located substantially in the extension 2*a* of the bore axis.

The hydraulic cylinder 7 determines the degree of the retraction of the cradle and, thereby, also the degree of elevation/depression of the gun, together with the abutment 11. This arrangement entails that elevation/depression of the gun may also imply a combined longitudinal and vertical displacement of the gun in the plane of elevation. When the journal 6 is displaced to the position 6' on elevation, the journal 13 will also be displaced to the position 13', and so on.

A distance A between the journals 9 and 12 exceeds a distance A' between the journals 6 and 13. The journal 12 is placed between the journals 5 and 9.

The crew turret is mounted on a journal 14 in a per se known manner. A journal ring 15 is also disposed on the tank for a loading pendulum 16. The journal ring is pivotal in relation to the crew turret 4, and its journal is illustrated by reference numeral 17. The tank is provided with a magazine 18 and has an aperture 19 on its upper side 1*a*. Through the aperture, the loading pendulum 16 collects rounds from the magazine in a per se known manner. The loading pendulum operates in the space between the upper side 1*a* of the tank and the lower side of the breech 2*b* of the gun. The loading pendulum includes a basket 16*a* and a fork-shaped journal arm 16*b* whose journalling in the journal ring is illustrated by reference numeral 20. The journalling of the basket in the journal arm is indicated by reference numeral 21.

The asymmetry in the journals 6 and 20 would entail that the pivotal movement of the loading pendulum about the journal 20 would be dependent upon the elevation/depression of the gun if the present invention had not been utilized in the tank. Such a drawback would have entailed that the position of the basket did not agree with the infeed position 2*c* of the breech at all elevations of the gun. However, as a result of the longitudinal displacement of the gun in response to the degree of elevation, the infeed opening 2*c* of the breech is adapted to the loading pendulum irrespective of the elevation of the gun.

As a result of the journalling of the basket in its journal arm, the basket may pivot in relation to the arm for adaptation to the infeed opening 2*c* in the breech. The gun may be elevated and depressed at the angles $\alpha$ and $\beta$, respectively. Solid lines on the Drawing show zero elevation. Broken lines indicate elevated/depressed positions of the gun. One elevation position for the breech has been designated 2' and one depression position has been designated 2''. Intimations of the positions of other parts in the above-mentioned elevation and depression positions are given by broken lines.

By rendering the journal 12 for the abutment vertically adjustable in the crew turret, a vertically adjustable function may be obtained for the superjacent gun in relation to the upper side 1*a* of the tank. The abutment may also consist of a cylinder 11', so as to attain the same function. According to one embodiment, the abutment may consist of a screw. Hydraulic cylinders/screws may be controlled in known manners and do not in themselves affect the invention. As a result of its anchorage arrangement, the loading pendulum may be pivoted in relation to the crew turret so as, when the gun is traversed, to be capable of being moved to the aperture 19, there to collect a round. After collecting the round, the loading pendulum may be returned to a position which corresponds to the laterally traversed position of the gun, where it can pivot up towards the infeed opening 2*c*.

The present invention should not be considered as restricted to the embodiment described above and shown on the Drawing by way of example, many modifications being conceivable without departing from the spirit and scope of the appended claims.

What we claim and desire to secure by Letters Patent is:

1. In a tank having an overlying gun and a loading pendulum, the gun being pivotably mounted in a cradle which is disposed on a revolvable portion of the tank, and the loading pendulum pivotably mounted on a ring member rotatable with respect to the revolvable portion with a pivotal center of the pendulum being offset from a pivotal center of the gun;

a device for adjustably mounting the gun with respect to movements of the loading pendulum having a journal that maintains a fixed distance with respect to a central revolving axis of the revolvable portion of the tank, said device comprising:

means effecting elevation/depression movements of the gun with respect to the tank;

means for controlling retraction of the gun, cooperating with said means for effecting the elevation/depression movement;

means for longitudinal/vertical displacement of the gun in the plane of elevation at different elevation/depression positions of the gun adapted to adjust a position of a breech of the gun to pivotal movements of said longitudinally fixed loading pendulum.

2. The device as claimed in claim 1, wherein said means for longitudinal/vertical displacement of the gun includes said cradle retractable in the plane of elevation and an abutment member pivotally mounted at one end in the gun and at another end on the revolving portion.

3. The device as claimed in claim 2, wherein the member for controlling retraction of said gun includes at least one first hydraulic cylinder.

4. A device in a tank including an overlying gun mounted in a pivotally mounted cradle which is disposed on a revolving portion of the tank, and a loading pendulum having a journal that maintains a fixed distance with respect to a central revolving axis of the revolvable portion of the tank, and disposed on a journal ring pivotal in relation to the revolving portion, a journal arm of the loading pendulum pivoting, as seen in a plane of elevation, about a pivotal central which is offset from the pivotal center of the gun mounted in the cradle, said device comprising:

means for retracting said cradle in the plane of elevation;

a member for controlling the retraction of the gun; and an abutment having its ends pivotally mounted on the revolving portion and the gun, respectively, and movable in the plane of elevation; the gun being adapted for elevation/depression about said abutment, wherein said pivotally mounted cradle and said abutment, controlled by said member for controlling retraction, are adapted at different elevation/depression positions of the gun to adjust a position of a breech of the gun to the pivotal movement of the longitudinally fixed loading pendulum about its pivotal center by longitudinally/vertically displacing the gun in the plane of elevation.

5. The device as claimed in claim 4, wherein the abutment has one end pivotally journalled on the revolving portion and the second end pivotally journalled in the gun.

6. The device as claimed in claim 4, wherein the abutment has one end journalled in an extension of a bore axis of the gun.

7. The device as claimed in claim 4, wherein the end of the abutment mounted on the revolving portion is pivotal about a journal disposed between a journal of the cradle mounted on the revolving portion and a journal of the member for controlling retraction of the cradle which is also mounted on the revolving portion.

8. The device as claimed in claim 7, wherein a distance between the journals for journalling of the cradle and of the member for controlling retraction, disposed on the revolving portion, exceeds a distance between a journal for mounting the gun in the cradle and a journal for mounting of the abutment in the gun.

9. The device as claimed in claim 4, wherein the member for controlling retraction consists of at least one first hydraulic cylinder.

10. The device as claimed in claim 9, wherein the member for controlling retraction of the gun in the cradle cooperates with the cradle at the free end of the cradle.

11. The device as claimed in claim 9, wherein the journal arm of the loading pendulum is mounted about a journal disposed on the journal ring which, when the loading pendulum is pivoted inwardly to the plane of elevation, is located behind a journal of the cradle disposed on the revolving portion.

12. The device as claimed in claim 4, wherein the member for controlling retraction of the gun in the cradle cooperates with the cradle at a free end of the cradle.

13. The device as claimed in claim 4, wherein the journal arm of the loading pendulum is mounted about a journal disposed on the journal ring which, when the loading pendulum is pivoted inwardly to the plane of elevation, is located behind a journal of the cradle disposed on the revolving portion.

14. The device as claimed in claim 4, wherein the abutment has one end journalled in an extension of a bore axis of the gun.

* * * * *